US005667420A

United States Patent [19]

Menow et al.

[11] Patent Number: 5,667,420

[45] Date of Patent: Sep. 16, 1997

[54] ROTATING VEHICLE TOY

[75] Inventors: Steven M. Menow, Langhorne, Pa.; Jonathan Adam Jaffe, Voorhees, N.J.; Patrick J. Sannito, West Deptford, N.J.; Warren E. Bosch, Florence, N.J.

[73] Assignee: Tyco Industries, Inc., Mt. Laurel, N.J.

[21] Appl. No.: 186,715

[22] Filed: Jan. 25, 1994

[51] Int. Cl.[6] ..... A63H 17/14; A63H 30/04

[52] U.S. Cl. ..... 446/433; 446/456; 446/460; 180/65.6; 180/6.5; 180/22

[58] Field of Search ..... 446/462, 465, 446/437, 457, 456, 460, 433, 443, 470; 180/65.6, 24.06, 6.5, 245, 248, 22, 209

[56] References Cited

U.S. PATENT DOCUMENTS

| | | | |
|---|---|---|---|
| D. 247,192 | 2/1978 | Gardner | D34/15 AJ |
| 552,881 | 1/1896 | Thomson | 446/459 X |
| 1,333,216 | 3/1920 | Pajeau | 446/451 |
| 1,871,297 | 8/1932 | Berger | 446/433 |
| 2,224,411 | 12/1940 | Smith | 180/29 |
| 2,601,006 | 6/1952 | Rodabaugh . | |
| 3,190,384 | 6/1965 | Dufresne | 180/6.7 |
| 3,351,037 | 11/1967 | Meili | 115/1 |
| 3,372,766 | 3/1968 | Lifferth | 180/7 |
| 3,599,366 | 8/1971 | Pauly et al. . | |
| 3,720,019 | 3/1973 | Waznys et al. . | |
| 3,959,920 | 6/1976 | Ieda . | |
| 4,156,986 | 6/1979 | Kupperman et al. . | |
| 4,213,270 | 7/1980 | Oda . | |
| 4,226,292 | 10/1980 | Monte et al. | 180/6.5 |
| 4,306,630 | 12/1981 | Monte et al. | 180/22 |
| 4,329,810 | 5/1982 | Terui . | |
| 4,363,187 | 12/1982 | Shinohara . | |
| 4,459,776 | 7/1984 | Jaworski et al. | 446/462 |
| 4,475,611 | 10/1984 | Fisher | 180/6.5 |
| 4,490,124 | 12/1984 | Ogawa | 446/464 |
| 4,508,516 | 4/1985 | D'Andrade et al. | 446/443 |
| 4,511,343 | 4/1985 | Goldfarb et al. | 446/463 |
| 4,543,073 | 9/1985 | Matsuda | 446/230 |
| 4,556,397 | 12/1985 | Arad et al. | 446/436 |
| 4,562,893 | 1/1986 | Cunard | 180/6.5 |

(List continued on next page.)

FOREIGN PATENT DOCUMENTS

| | | |
|---|---|---|
| 0187895 | 7/1986 | European Pat. Off. . |
| 2114012 | 8/1983 | United Kingdom . |
| 2164263 | 6/1985 | United Kingdom . |

OTHER PUBLICATIONS

1993 Advertisement from Radio Shack.
1993 Packaging for ECHOPRO Radio Control "Wild Stunter" (2 pages).
1989 Label for Lionel "Revolver" (2 pages).
1986 Tyco Catalog (cover page and p. 65).
1985 Taiyo Kogyo, Co., Ltd., Radio Control catalog (pp. 6–8, 31).
1983 Ideal catalog (cover page, pp. 16, 17, 30–33).

*Primary Examiner*—Mickey Yu
*Attorney, Agent, or Firm*—Panitch Schwarze Jacobs & Nadel, P.C.

[57] ABSTRACT

A vehicle toy has two lateral sides, front and rear ends, an outer perimeter extending around the front and rear ends between the lateral sides, and three pairs of wheels, each pair having a common rotational axis. The wheels of each wheel pair are opposed to one another on the lateral sides. The wheels on each lateral side of the vehicle are arranged in a polygon at the outer perimeter, extending around the front and rear ends between the lateral sides such that adjoining pairs of the wheels define planes which are mutually transverse to one another and which entirely circumscribe the outer perimeter of the vehicle. Two wheel pairs are located proximal the rear end, with one of the two wheel pairs being oriented above the other, and the third wheel pair is located proximal the front end, so that the transverse planes form a triangle. The vehicle is driven by twin electric motors which are radio controlled for remote, independent and separate operation. Each motor is drivingly coupled to the two wheels proximal the rear end on a separate lateral side of the vehicle. The vehicle is balanced and powered sufficiently so that it can rotate and operate on any of the three planes.

25 Claims, 6 Drawing Sheets

U.S. PATENT DOCUMENTS

| | | | |
|---|---|---|---|
| 4,573,944 | 3/1986 | Crow et al. | 446/465 |
| 4,576,583 | 3/1986 | Yoneda | 446/94 |
| 4,588,386 | 5/1986 | Kennedy et al. | 446/6 |
| 4,591,346 | 5/1986 | Ikeda | 446/437 |
| 4,596,534 | 6/1986 | Ishimoto | 446/466 |
| 4,626,223 | 12/1986 | Sweet | 446/279 |
| 4,654,659 | 3/1987 | Kubo | 340/825 |
| 4,655,724 | 4/1987 | Law | 446/443 |
| 4,655,727 | 4/1987 | Swisher et al. | 446/470 |
| 4,666,420 | 5/1987 | Nagano | 446/443 |
| 4,680,021 | 7/1987 | Maxim | 446/457 |
| 4,696,655 | 9/1987 | D'Andrade et al. | 446/330 |
| 4,717,367 | 1/1988 | Stubenfoll et al. | 446/437 |
| 4,729,444 | 3/1988 | Tubman | 180/9.22 |
| 4,813,906 | 3/1989 | Matsuyama et al. | 446/457 |
| 4,822,316 | 4/1989 | Shaffer et al. | 446/466 |
| 4,846,758 | 7/1989 | Chou | 446/437 |
| 4,889,515 | 12/1989 | Auer et al. | 446/428 |
| 4,892,503 | 1/1990 | Kumazawas | 446/456 |
| 4,894,042 | 1/1990 | Kamikawas | 446/437 |
| 4,969,851 | 11/1990 | Rasmussen | 446/444 |
| 5,019,009 | 5/1991 | Lin et al. | 446/437 |
| 5,045,016 | 9/1991 | Stern et al. | 446/409 |
| 5,090,934 | 2/1992 | Quercetti | 446/93 |
| 5,135,427 | 8/1992 | Suto et al. | 446/433 |
| 5,259,808 | 11/1993 | Garr | 446/437 |

ROTATING VEHICLE TOY

FIELD OF THE INVENTION

The present invention relates to vehicle toys and, in particular, to vehicle toys which are capable of turning themselves over and being operated in any rotational orientation they may find themselves in.

BACKGROUND OF THE INVENTION

Vehicle toys are well known. Remotely controlled and, in particular, radio-controlled vehicles have come to constitute a significant specialty toy market.

Manufacturers in this market attempt to duplicate well known vehicles as well as the latest in automotive developments, including specialty entertainment vehicles, such as four wheel drive vehicles, race car vehicles, and military vehicles. In addition, manufacturers constantly seek new ways and features to add innovative action to such toys to make such vehicles more versatile and/or entertaining.

One significant problem with remote control vehicles, and indeed most powered toy vehicles, is they have a tendency to flip over when operating and/or maneuvering at high speed. The operator is often required to stop the motor and manually right the vehicle.

It would be desirable to provide a vehicle toy capable of high speed operation with the advantage that if it flips over, it can continue operate. In addition to providing uninterrupted operation, a sufficiently powered and properly designed toy vehicle would also be able to provide innovative tricks, such as quick flips and pirouettes.

SUMMARY OF THE INVENTION

Briefly stated, the present invention in one aspect is a vehicle toy having first and second lateral sides, front and rear ends, and an outer perimeter. The vehicle toy has at least three pairs of wheels, each pair having a common rotational axis. The wheels of each wheel pair are opposed to one another on the first and second lateral sides. Further, the wheels on each of the first and second lateral sides of the vehicle are arranged in a polygon at the outer perimeter, such that adjoining pairs of the wheels define planes which are mutually transverse to one another and which entirely circumscribe the outer perimeter of the vehicle. The toy vehicle also includes motor means drivingly coupled with at least two pairs of wheels for driving the at least two pairs of wheels.

In another aspect, the invention is a vehicle toy comprising first and second lateral sides, front and rear ends, and an outer perimeter. The vehicle has first, second and third wheels pairs, each wheel pair having a common rotational axis. The wheels of each wheel pair are located opposite one another on the first and second lateral sides, and the wheels on each lateral side of the vehicle are triangularly positioned to entirely circumscribe the outer perimeter, such that only two wheel pairs contact a generally level surface at a time and such that the vehicle can be operated on any two adjoining pairs of the three pairs of wheels. A first reversible electric motor is drivingly coupled with at least two wheels on the first lateral side, the at least two wheels being coupled together for common rotation and a second reversible electric motor drivingly coupled independently of the first motor with at least two wheels on the second lateral side opposing the at least two coupled wheels on the first lateral side, the wheels on the second lateral side being coupled together for common rotation.

In yet another aspect, the invention is a vehicle toy comprising first and second lateral sides, front and rear ends, and an outer perimeter. The vehicle has at least three pairs of wheels, each pair having a common rotational axis. The wheels of each wheel pair are opposed to one another on the first and second lateral sides, and the wheels on each lateral side of the vehicle are arranged in a polygon at the outer perimeter, such that adjoining pairs of the wheels define planes which are mutually transverse to one another and which entirely circumscribe the outer perimeter of the vehicle, wherein two wheel pairs are located proximal the rear end, and one wheel pair is located proximal the front end, such that the transverse planes form a triangle. A first reversible electric motor is drivingly coupled to at least two wheels proximal the rear end on one of the two lateral sides of the vehicle, and a second reversible electric motor, independently operable from the first motor, is drivingly coupled to at least two wheels proximal the rear end on a remaining one of the two lateral sides of the vehicle opposing the two wheels on the one lateral side. The vehicle includes a controller responsive to control signals received from a source remote to the vehicle. The controller is coupled with the first and second electric motors, and the vehicle is balanced and powered sufficiently to rise up from an initial orientation supported by the one pair of unpowered wheels proximal the front end and one pair of the powered wheels proximal the rear end and to rotate to a second orientation supported on the two pairs of powered wheels proximal the rear end and to be rotated from the second orientation to a third orientation supported on a remaining one of the pairs of powered wheels proximal the rear end and the one pair of unpowered wheels proximal the front end.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings, which are diagrammatic.

DETAILED DESCRIPTION OF PREFERRED EMBODIMENTS

Figure 1:
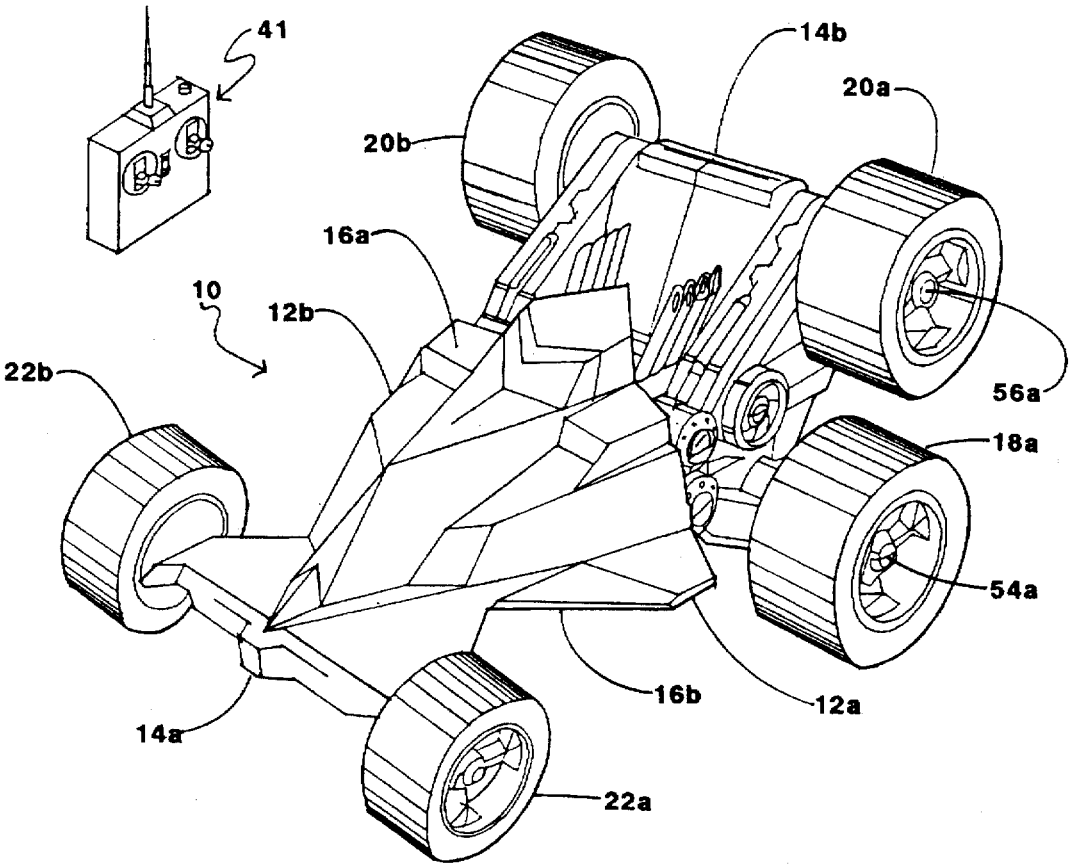
FIG. 1 is a perspective view of a vehicle toy according to a first embodiment of the present invention with remote controller.

Certain terminology is used in the following description for convenience only and is not limiting. The words "right," "left," "lower," and "upper" designate directions in the drawings to which reference is made. The terminology includes the words above specifically mentioned, derivatives thereof and words of similar import.

Referring now to the drawings in detail, wherein like numerals are used to indicate like elements throughout, a first embodiment vehicle toy taught through the present invention is indicated generally at 10 in FIGS. 1 through 6. The vehicle 10 preferably comprises first and second lateral sides 12*a*, 12*b*, front and rear ends, 14*a*, 14*b*, "top" and "bottom" sides 16*a* and 16*b*, and an outer perimeter. The outer perimeter of the vehicle 10 is defined herein as circumscribing the vehicle 10 between the lateral sides 12*a*, 12*b*. The outer perimeter of the vehicle 10 extends around the front end 14*a* of the vehicle 10, over the top side 16*a* around the rear end 14*b*, along the bottom side 16*b* and back to the front end 14*a*.

The vehicle 10 has at least three pairs of wheels, each pair having a common rotational axis. In the first embodiment, the vehicle has three pairs of vehicle supporting, road contacting wheels, 18*a*/18*b*, 20*a*/20*b* and 22*a*/22*b*. The wheels of each wheel pair 18*a*/18*b*, 20*a*/20*b*, 22*a*/22*b* are opposed to one another on the first and second lateral sides 12*a*, 12*b*. The wheels on each lateral side 12*a*, 12*b* of the vehicle 10 are arranged in a polygon at the outer perimeter of the vehicle 10, such that adjoining pairs of the wheels or at least their outermost surfaces define planes 24, 26, 28 (see FIG. 2) which are mutually transverse to one another and which entirely circumscribe the outer perimeter of the vehicle 10.

Although the vehicle 10 shown and described has three wheel pairs 18*a*/18*b*, 20*a*/20*b*, 22*a*/22*b*, it is within the scope of the present invention that more than three pairs of wheels may be used, such that the wheels on each lateral side of the vehicle are arranged in a polygon at the outer perimeter of the vehicle, and circumscribe the outer perimeter of the vehicle. If more than three pairs of vehicle supporting wheels are used, adjoining pairs of the wheels would preferably be used to define more than three planes which are mutually transverse to one another.

As shown in the drawings, two wheel pairs 18*a*/18*b*, 20*a*/20*b* are located proximal the rear end 14*b*, and one wheel pair 22*a*/22*b* is located proximal the front end 14*a*, such that the transverse planes 24, 26, 28 form a triangle. In the presently preferred embodiment, the geometry of the vehicle 10 is in the shape of a triangle, indicated by a triangle ABC in FIG. 2, connecting the center point of each wheel on a lateral side. The triangle may be substantially or essentially isosceles, but need not be any particular type of triangle. It is noted that the wheels 20*a*/20*b* are located forward and above wheels 18*a*/18*b* when the vehicle 10 is supported on wheels 18*a*/18*b* and 22*a*/22*b*.

The vehicle 10 of the present invention is capable of turning itself over and operating in any rotational orientation it may find itself in (i.e. on any of the three planes 24, 26, 28). Preferably, the vehicle 10 is balanced and powered sufficiently to rise up from an initial orientation supported by the first and third wheel pairs 18*a*/18*b*, 22*a*/22*b* and to rotate to a second orientation (FIG. 4) supported on the first and second wheel pairs 18*a*/18*b*, 20*a*/20*b* and can be rotated from the second orientation to a third orientation (FIG. 5) supported on the second and third wheel pairs 20*a*/20*b*, 22*a*/22*b*. The two pairs of wheels 18*a*/18*b*, 20*a*/20*b* proximal the rear end 14*b* are spaced sufficiently far apart from one another so that the vehicle 10 can maintain itself upright on the two pairs of wheels 18*a*/18*b*, 20*a*/20*b* when the vehicle 10 is operated with the two pairs of wheels 18*a*/18*b*, 20*a*/20*b* in contact with a surface supporting the vehicle 10. The vehicle 10 can also be started on third plane 28 and rotated to second plane 26 or started on the second plane 26 and rotated to either the first plane 24 or the third plane 28.

The vehicle toy 10 currently comprises a body 30, which forms the upper portion of the vehicle 10 including top side 16*a*, and a chassis, generally indicated at 32, which forms the lower portion of the vehicle 10 including the bottom side 16*b*. The vehicle body 30 is made of, for example, plastic or any other suitable material. The depicted vehicle 10 has a streamlined shape with a front end 14*a* which is sharp or somewhat pointed in plan and side elevation views, and a width and height gradually increasing toward the rear end 14*b*. Although the vehicle 10 shown is in the form of an angled aerodynamic style, the vehicle 10 could be in the form of other aerodynamic styles or conventional passenger car, truck, and other vehicle styles. The vehicle 10 may also be equipped with lights, such as light 15, which is illuminated when the vehicle is being operated.

Although the presently preferred embodiment of the vehicle 10 comprises a chassis 32 and a body 30, it is within the scope of the invention that the vehicle toy could be made without a body portion, or with a chassis integral to the body or with the body and chassis formed by laterally opposing shells. Preferably, the chassis 32 is further provided with mechanical detailing which becomes visible when the vehicle is rotated to or operated in the second or third orientations (FIGS. 4–5), previously discussed. For instance, the chassis 32 can be provided with details such as a turbine, an exhaust system, suspension, motor and/or drive train details. The vehicle 10 could also simulate different style vehicles on the top and bottom surfaces 16*a*, 16*b*, such that the bottom surface 16*b* also simulates a vehicle, either the same as or different from the vehicle style simulated on the top surface. This design would obscure the difference between a "top" and a "bottom" surface, since either would look like a top surface of a vehicle. The differentiation between different surfaces can be enhanced by using contrasting colors.

Figure 2:
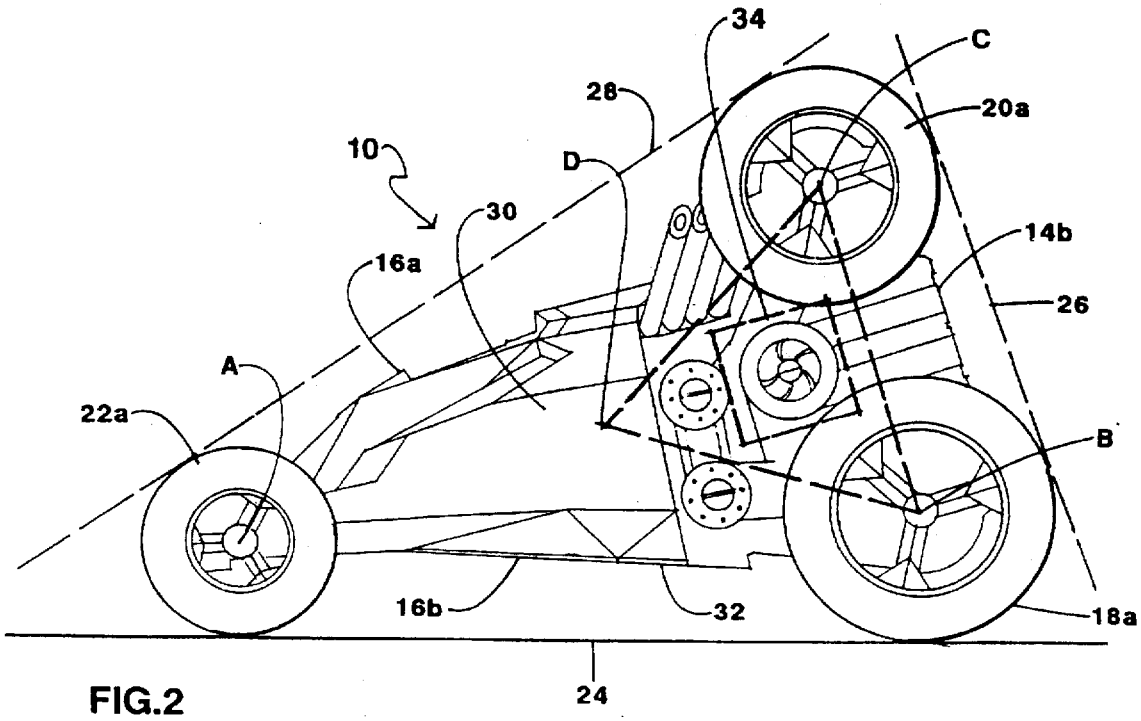
FIG. 2 is a side view of the vehicle toy of FIG. 1 in a first orientation supported on a first wheel pair and a third wheel pair.
Figure 4:
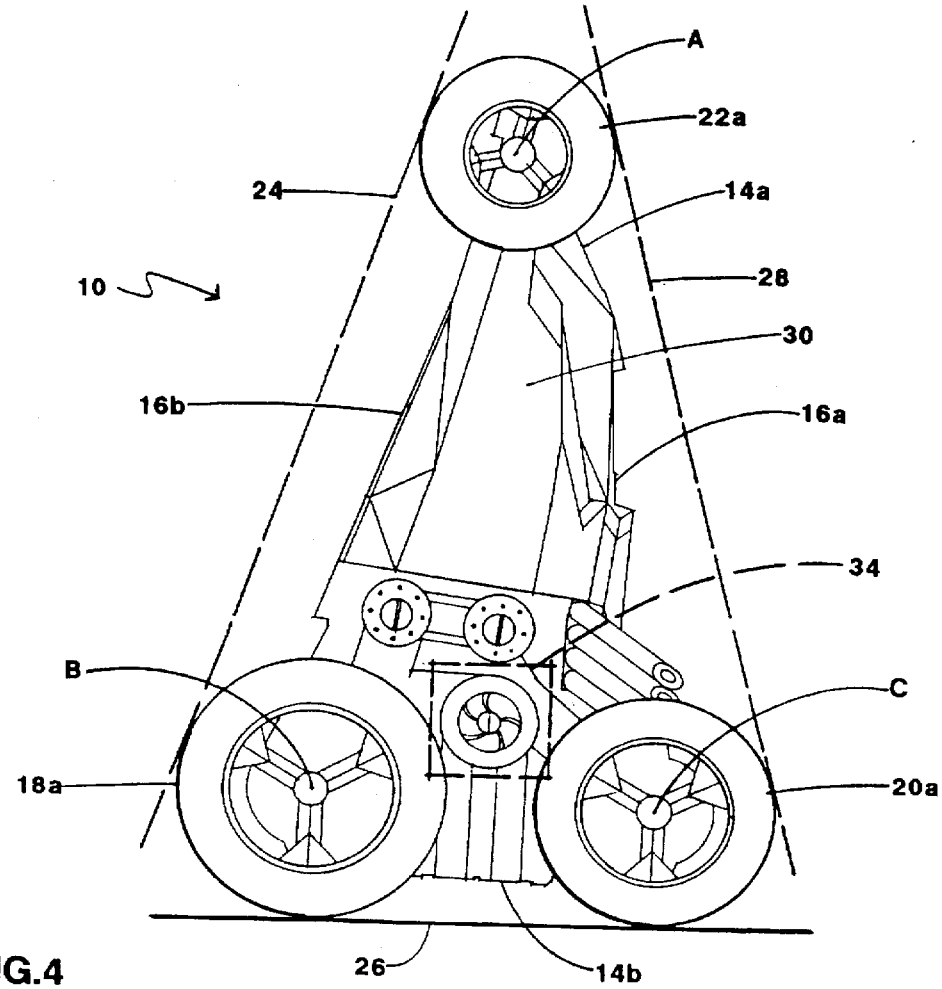
FIG. 4 is a side view of the vehicle toy of FIG. 1 in a second orientation supported on the first wheel pair and a second wheel pair.
Figure 5:
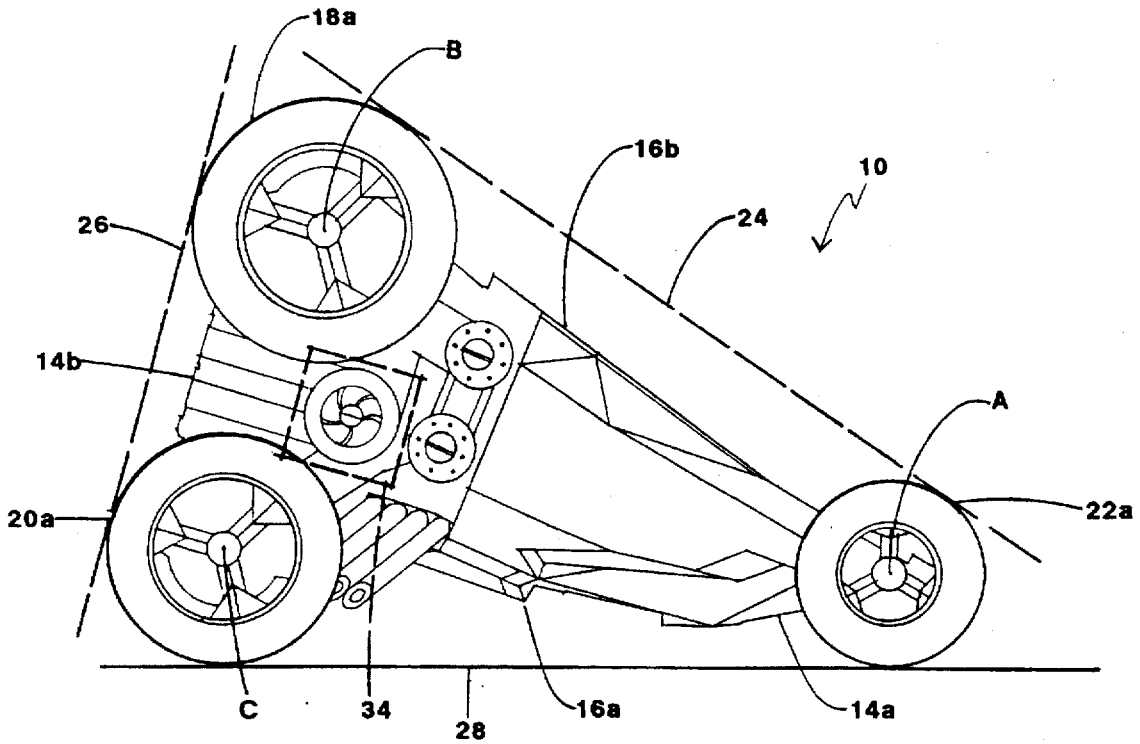
FIG. 5 is a side view of the vehicle toy of FIG. 1 in a third orientation supported on the second and the third wheel pairs.

The vehicle 10 is driven by motor means indicated generally at 34 (in phantom in FIGS. 2, 4 and 5), which are preferably drivingly coupled with at least two pairs of wheels, for driving the at least two pairs of wheels. Referring particularly to FIGS. 2, 4 and 5, when the vehicle surface contacting wheels on each lateral side are configured as a triangle, providing motor means which are drivingly coupled with at least two pairs of the wheels allows the vehicle to operate on any of the three aforementioned planes. The motor means 34 preferably are mounted to the vehicle chassis 32 and within the vehicle body 30.

The motor means 34 of the present invention preferably comprises first and second independently operable, reversible electric motors 34a, 34b, which operate in a conventional manner like that disclosed in U.S. Pat. No. 5,135,427, which is incorporated by reference herein in its entirety. Each motor 34a, 34b is drivingly coupled with at least two of the road contacting wheels on each lateral side 12a, 12b for driving the at least two wheels. In the presently preferred embodiment, the two wheel pairs 18a/18b, 20a/20b proximal the rear end 14b' of the vehicle are powered and the third wheel pair 22a/22b proximal the front end 14a of the vehicle is unpowered. The first reversible motor 34a is drivingly coupled to wheels 18a, 20a, proximal the rear end 14b on the first side 12a of the two lateral sides 12a/12b via a drive train indicated generally at 36a. The opposing wheels 18b, 20b proximal the rear end 14b on the remaining lateral side 12b are driven in like manner by the second reversible motor 34b via a drive train also indicate generally at 36b, which is a mirror image of the drive train 36a. Thus, the rear wheels 18a, 20a are driven independently of rear wheels 18b, 20b, since the electric motors 34a, 34b are independently operable. Further, the electric motors 34a/34b are reversible, so that the wheels 18a, 20a and 18b, 20b can be simultaneously driven in the same or opposite linear directions, or one set of wheels 18a, 20a or 18b, 20b can be driven while the other set of wheels is stationary. In this manner, the vehicle 10 can be made to turn, spin, or even pirouette without any need for any of the wheel pairs 18a/18b, 20a/20b, 22a/22b to be pivotable. Accordingly, in the presently preferred embodiment, the wheel pairs 18a/18b, 20a/20b, 22a/22b are mounted for rotational movement with respect to only the common rotational axis of each wheel pair.

Figure 6:
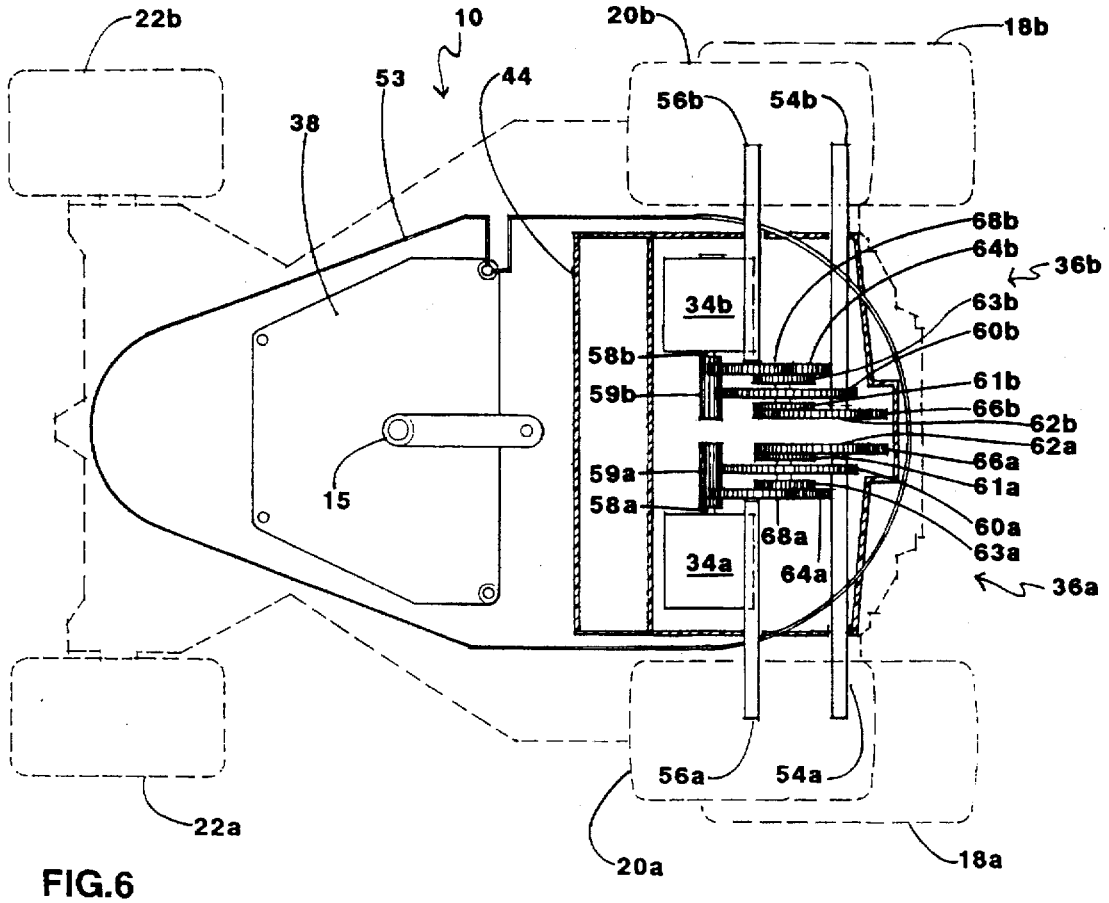
FIG. 6 is a partially sectioned top plan view of the vehicle toy of FIG. 1 with the body indicated in phantom for clarity.
Figure 7:
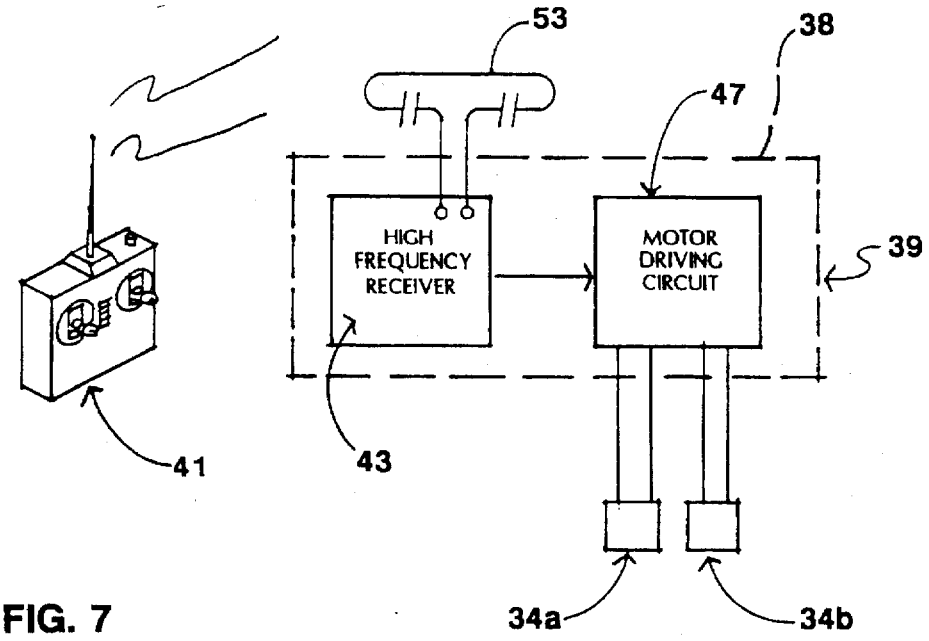
FIG. 7 is a block diagram illustrating a controller of the preferred embodiment.

Referring now to FIG. 7, also provided is a receiving substrate or circuit board 38 (in phantom) including circuitry constituting a controller, indicated generally at 39, responsive to control signals received from a source remote to the vehicle 41, such as a hand-held controller like that disclosed in the aforesaid U.S. Pat. No. 5,135,427. The circuit board 38 is coupled with the motor means 34a, 34b to control operation of the motor means 34a, 34b. The controller 39 includes a high frequency receiver circuitry 43 for radio signal receiving and processing and motor driving circuitry 47, all or substantially all of which is integrated on the circuit board 38, to provide remote radio control of the motor means 34a, 34b. Preferably, the circuit board 38 is mounted to a front portion of the chassis 32 via tubular support bars 40. The controller 39 picks up the radio signals by means of an antenna 53 (FIG. 6) which is preferably located at least substantially within the body 30. The circuitry is entirely conventional, and generally known to those of ordinary skill in the art of radio controlled, electric toy vehicles. Such circuitry and control elements are described, for example, in the aforesaid U.S. Pat. No. 5,135,427. Such control systems can be obtained directly from manufacturers, such as Taiyo Kogyo of Tokyo, Japan and others or U.S. distributors selling radio control vehicle products and/or parts. Since the vehicle 10 of the present invention uses the same or similar controller circuitry as described in U.S. Pat. No. 5, 135,427, these elements will not be further discussed herein. Although the presently preferred embodiment toy vehicle is remotely controlled via radio signals, it should be understood that both hard wire and wireless controlled vehicle toys are within the scope of the invention.

The motor means 34 is mounted to a rear portion of the chassis 32 via arm mounts 42. Located between the motor means 34 and the circuit board 38 is a battery compartment 44 for receiving a battery power source 45 (in phantom). The presently preferred power source comprises a rechargeable battery or battery pack. The battery compartment 44 is secured to the chassis 32 via arm mounts 46. The battery compartment 44 is accessible to a user by means of a lid 48. The lid 48 opens and closes via pivot 50, and can be secured to the chassis 32 via latch 52. The power source 45 powers both the electric motors 34a, 34b and the controller circuitry of the circuit board 38.

The wheel pairs of the vehicle 10 will now be discussed. Referring to FIG. 2, it can be seen that in the presently preferred embodiment, the diameter of the wheels varies between the three wheel pairs 18a/18b, 20a/20b, 22a/22b. The first wheel pair 18a/18b has the largest diameter. The second wheel 20/20b pair has a diameter which is less than the diameter of the first wheel pair 18a/18b, and the third wheel pair 22a/22b has the smallest diameter. The wheels can be made from rubber or other suitable materials commonly used for tires. The wheels can also be equipped with nubs (not shown) to improve traction when the vehicle 10 is operated off of a hard, smooth surface. In the preferred embodiment, the front wheel pair 22a/22b is made from plastic, as opposed to rubber, to reduce friction generated by, and therefore traction of the front wheel pair 22a/22b to assist the vehicle 10 in turning while the vehicle 10 is being supported on the front wheel pair 22a/22b. Both rear wheel pairs 18a/18b, 20a/20b are mounted so that the outermost portions thereof are spaced beyond the remainder of the vehicle 10. The front wheel pair 22a/22b is mounted so that the outermost portions thereof are also spaced beyond the front end 14a of the vehicle 10. Thus, the vehicle wheels 18a/18b, 20a/20b, 22a/22b entirely circumscribe the vehicle 10.

Preferably, separately controlled, first and second (left and right) reversible, electric motors 34a, 34b are located proximal the rear end 14b of the vehicle 10. Motor 34a is drivingly coupled to rear wheels 18a and 20a, and motor 34b is drivingly coupled to rear wheels 18b and 20b. The rear wheels 18a, 20a, are mounted on shaft ends of lower and upper, left rear drive shafts 54a, and 56a, which horizontally project from the side of the rear of the chassis 32. The rear wheels 18b, 20b on the opposing lateral side 12b, are also mounted on shaft ends of lower and upper right rear drive shafts 54b and 56b (FIG. 6). Preferably the two motors 34a, 34b are disposed on opposite sides proximal the rear end 14b of the vehicle 10 and are connected through respective drive trains 36a, 36b to drive shafts 54a, 56a and 54b, 56b extending generally horizontally and colinearly towards each other. The control terminals of the motors 34a, 34b, indicated diagrammatically in FIG. 7, are respectively electrically connected to predetermined positions on the circuit board 38 so that the motors 34a, 34b may be independently controlled by the motor driving circuitry 47.

Figure 3:
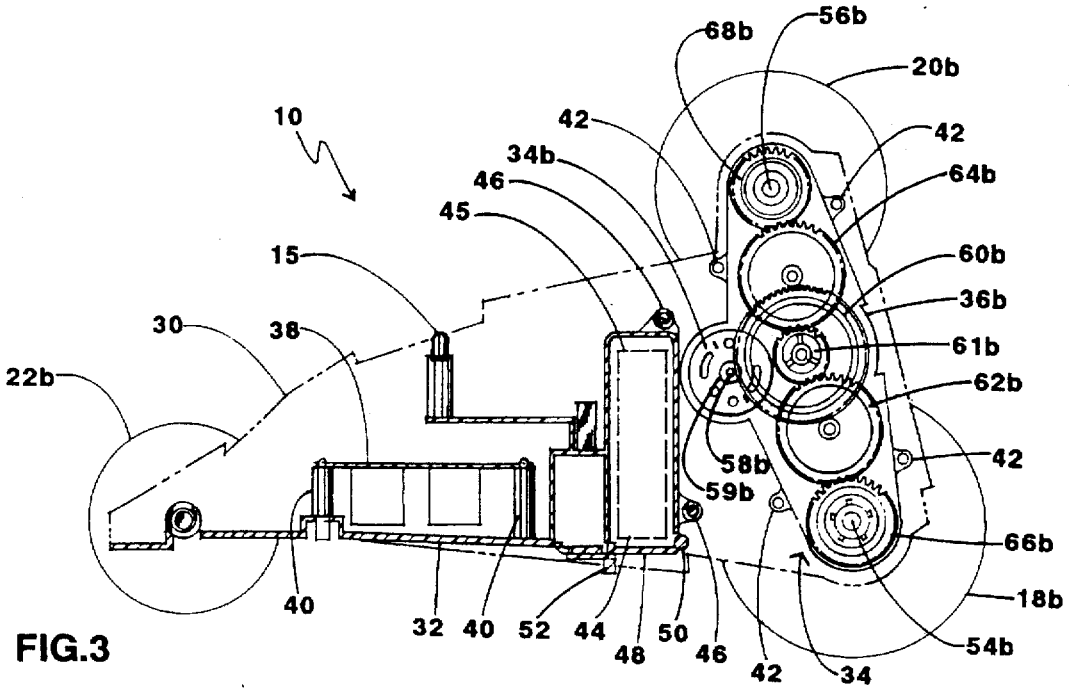
FIG. 3 is a partially sectioned side view of the vehicle toy in FIG. 2 with the body indicated in phantom and the wheels on a first lateral side removed, for clarity.

Motor 34a and its corresponding drive train 36a is a mirror image of motor 34b and its drive train 36b. Accordingly, only motor 34b and its drive train 36b will be described hereafter. Referring now in particular to FIG. 3 and FIG. 6, the motor 34b has an output shaft 58b driving a pinion 59b which is engaged with a large gear 60b. The large main gear 60b rotates two smaller gears 61b, 63b, located on opposite sides of the large main gear 60b. The two smaller gears 61b, 63b are engaged with lower and upper intermediate idler gears 62b, 64b, which are, in turn, engaged with lower and upper smaller gears 66b, 68b which are non-rotatably affixed to the drive shafts 54b, 56b. It is understood by those of ordinary skill in the art from this disclosure that the gear ratios between the idler gears 62b, 64b and the smaller gears 66b, 68b need not be equal, and may be varied in order to produce the same circumferential linear speed between the drive wheel pairs 18a/18b, 20a/20b so there is no slippage when the vehicle 10 is being operated on the two pairs of rear wheels 18a/18b, 20a/20b. Preferably, the lower and upper rear wheels 18b, 20b are keyed with the outer ends of the shafts 54b, 56b to withstand the output torque, but the wheels 18b, 20b can be only frictionally secured to the shafts if desired. It will thus be appreciated that rear wheels 18b, 20b are powered by motor 34b and are coupled together through drive train 36b and shafts 54b, 56b for common rotation. Having described one side of the vehicle 10, it is should be understood that the opposing side of the vehicle is a mirror image.

The operation of the vehicle toy 10 will now be discussed. Preferably, the vehicle 10 is balanced and powered sufficiently to rise up from an initial orientation (FIG. 2) supported by the first and third wheel pairs 18a/18b, 22a/22b and to rotate to a second orientation (FIG. 4) supported on the first and second wheel pairs 18a/18b, 20a/20b. Vehicle 10 can be rotated from the second orientation back to the first orientation by reversing direction sharply or on to a third orientation (FIG. 5) supported on the second and third wheel pairs 20a/20b, 22a/22b. Preferably, the two pairs of wheels 18a/18b, 20a/20b proximal the rear end 14b are spaced sufficiently far apart from one another so that the vehicle 10 can maintain itself upright on the two pairs of wheels 18a/18b, 20a/20b when the vehicle 10 is operated with the two pairs of wheels 18a/18b, 20a/20b in contact with a surface supporting the vehicle 10. The vehicle 10 can be accelerated sufficiently rapidly by the motor means 34 and wheels 18a/18b, 20a/20b to rotate the vehicle 10 in a first direction from one of the planes 24, 26, 28 to an adjacent one of the planes 26, 28 or back from plane 26, 28 to plane 24, 26 by sharply reversing direction. Thus, the vehicle 10 can move from one plane to another during operation, and can operate on any of the three planes 24, 26, 28.

In the vehicles of the present invention, preferably the two pairs of wheels 18a/18b, 20a/20b proximal the rear end 14b are spaced sufficiently far apart from one another such that the vehicle 10 can maintain itself upright on the two pairs of wheels 18a/18b, 20a/20b proximal the rear end 14b when the vehicle 10 is operated with the two pairs of wheels 18a/18b, 20a/20b proximal the rear end 14b in contact with a surface supporting the vehicle. The vehicle 10 of the present invention preferably is balanced and powered sufficiently so that it operates on any of two adjacent wheel pairs. Moreover, since the preferred embodiment of the vehicle 10 is driven by separate and independently operable twin reversible electric motors 34a, 34b, the vehicle 10 can be caused to turn, spin rapidly, or even pirouette, by driving the powered wheels 18a/18b, 20a/20b in opposite directions.

The vehicle 10 is powered by any of a variety of commercially available model DC motors, selected for the size weight and desired performance of the vehicle 10. The vehicle 10 has a center of gravity (with battery power supply installed), which is located in front of the rear wheel pairs 18a/18b, 20a/20b and proximal the rear end 14b. Additionally, the second wheel pair 20a/20b is located forward from and above the first wheel pair 18a/18b when the vehicle 10 is supported on the first 18a/18b and third 22a/22b wheels pairs. The center of gravity of the vehicle 10 is indicated at point D. A triangle drawn between points BCD (FIG. 2) is approximately an equilateral triangle. Locating the center of gravity at location D and providing sufficient spacing between wheels 18a/18b and 20a/20b improve the unique characteristics of the vehicle 10, allowing the vehicle 10 to operate on any of the three planes 24, 26, 28, as previously discussed, without rotating to an adjacent operational plane unless sufficiently accelerated.

Figure 8:
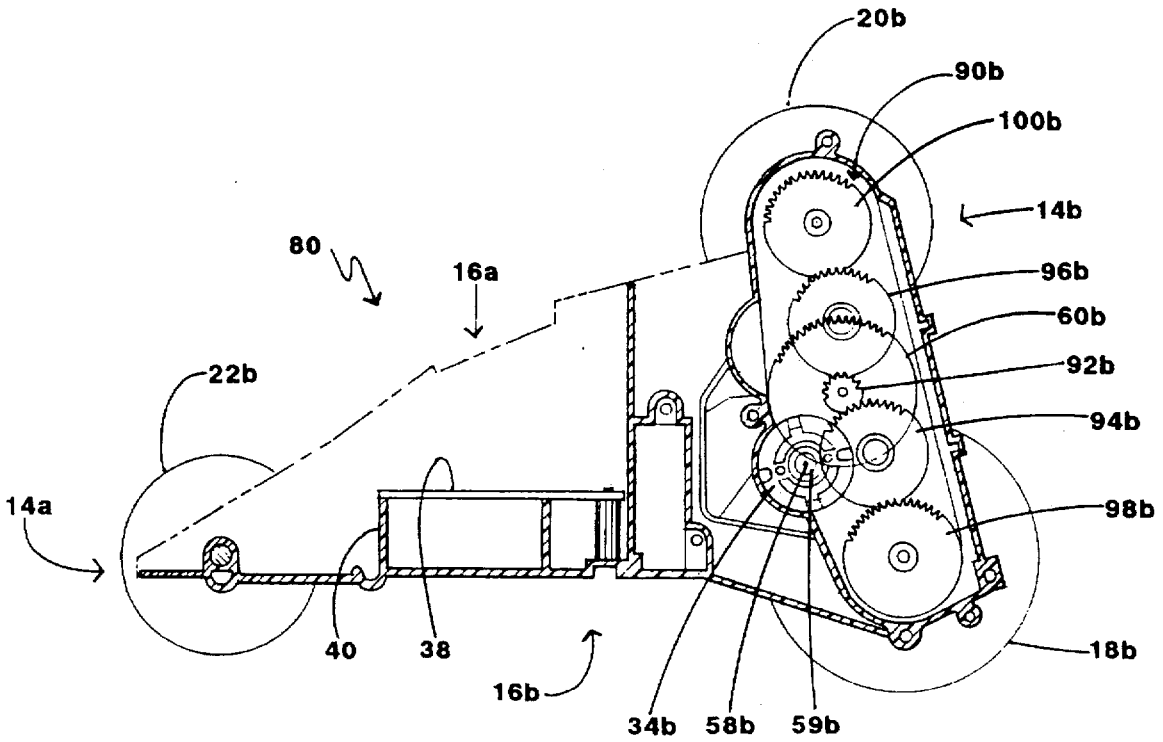
FIG. 8 is a partially sectioned side view of a second embodiment vehicle toy with the body indicated in phantom and the wheels and gear train on a first lateral side removed, for clarity.
Figure 9:
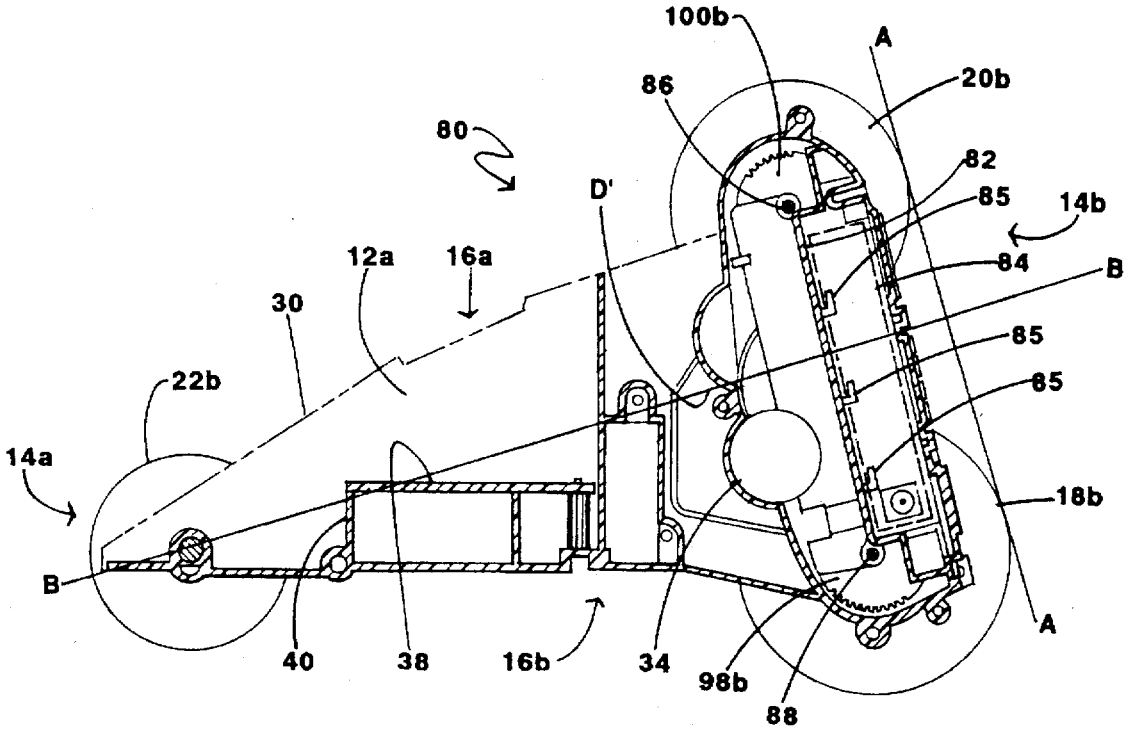
FIG. 9 is a partially sectioned side view of the vehicle toy of FIG. 8 with the body indicated in phantom and the wheels on a first lateral side removed, for clarity.
Figure 10:
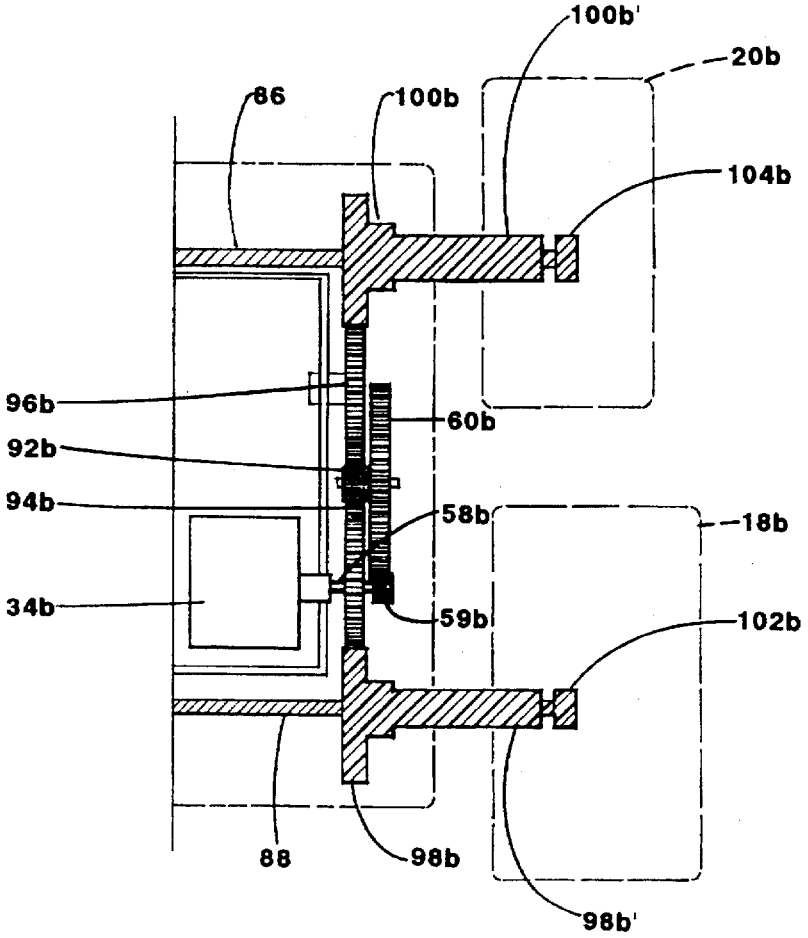
FIG. 10 is a detailed, partially broken away rear view of the rear portion of the vehicle toy of FIG. 8 and the articulate coupling between the gear train on a lateral side of the vehicle.

Referring now to FIGS. 8–10, a second embodiment of the present invention is shown. The second embodiment of the vehicle toy, indicated generally at 80, is basically the same as the first embodiment of the vehicle 10, as previously described, except that the vehicle 80 has a battery compartment 82 located at the rear end 14b of the vehicle 80. Additionally, the drive train and axles are different than the vehicle toy 10. Many of the elements common to both embodiments are omitted from FIGS. 8–10 for clarification of the differences.

As before, the vehicle 80 comprises first and second lateral sides 12a, 12b (see FIG. 1), front and rear ends 14a, 14b, and an outer perimeter. Additionally, the vehicle has a top and a bottom side 16a, 16b. The outer perimeter of the vehicle 80 is defined herein as circumscribing the vehicle 80 between the lateral sides 12a, 12b. The outer perimeter of the vehicle 80 extends around the front end 14a of the vehicle 80, over the top side 16a around the rear end 14b, along bottom side 16b and back to the front end 14a.

Since the basic vehicle 10 has already been described, those features which do not differ from the previously described version will not be described again. Referring particularly to FIG. 9, the battery compartment 82 of the vehicle toy 80 is located at the rear end 14b, in a generally vertical orientation. By locating the battery compartment 82, and a corresponding battery 84 (in phantom), the vehicle center of gravity is relocated. The center of gravity of the vehicle 80 is now located approximately at a point D' along a line B—B which is a bisector of a tangent A—A of the two drive wheels 18b, 20b extended to the axle of the front non-drive wheel 22b. It is desirable to locate the center of gravity along or at least close to the line B—B for stability while the vehicle 80 is being operated and supported on the two pairs of rear drive wheels 18a/18b, 20a/20b. Locating the center of gravity along the line B—B prevents the vehicle 80 from wobbling and toppling over. The center of gravity is located closer to tangent A—A than to the axle of front non-drive wheel 22b and preferably is located at least two-thirds of the distance of the line B—B from the axle of front non-drive wheel 22b towards the tangent line A—A.

The battery 84 is substantially rectangular in shape. The battery 84 is slide fit into the battery compartment 82 and mates with a plurality of L-shaped notches 85 located along the side walls of the battery compartment 82. The battery 84 has a plurality of complementary channels (not shown) along the battery sidewalls and a movable stop or tab, which aid in securing the battery 84 within the battery compartment 82.

Additionally, the vehicle 80 has a pair of drive trains which differ from the drive trains 36a, 36b previously described for the vehicle 10. Referring particularly to FIG. 8 and FIG. 10, the vehicle 80 has rear upper and lower axles 86 and 88, respectively. As before, the vehicle 80 is driven by first and second reversible electric motors 34a and 3 4b, respectively. Motor 34a and its corresponding drive train is a mirror image of motor 34b and its drive train 90b. Accordingly, only motor 34b and its drive train 90b will be described hereafter. The motor 34b has an output shaft 58b driving a pinion 59b which is engaged with a large main gear 60b. The large main gear 60b rotates a smaller gear 92b. The smaller gear 92b is engaged with lower and upper intermediate idler gears 94b, 96b, which are, in turn, engaged with lower and upper drive gears 98b, 100b, which are affixed to the lower and upper wheels 18b, 20b. The lower and upper drive gears 98b and 100b are supported by, but not affixed to the upper and lower axles 86, 88. It is understood by those of ordinary skill in the art from this disclosure that the gear ratios between the idler gears/drive gear pairs 94b/98b and 96b/100b need not be equal, and should be varied where the wheels 20a/20b and 18a/18b are of different diameters in order to drive the wheels 18a/18b, 20a/20b at the same circumferential linear speed so there is no slippage when the vehicle 80 is being operated on the two pairs of rear wheels 18a/18b, 20a/20b. In this embodiment, the lower and upper rear wheels 18b, 20b preferably are keyed with drive gears 98b, 100b, for example by providing a polygon shaped outer end 98b' and 100b' which is received in mating polygon wells concentrically located on the inner sides of the wheels 18b/20b. The gears 98b, 100b thus transmit torque directly to the wheels 18b, 20b. The axles 88, 86 connect to both wheels of each wheel pair 18a/18b and 20a/20b, respectively, and provide only support to the vehicle wheels 18a/18b, 20a/ 20b. Wheels 18b and 20b may be retained on shafts 88 and 86 in mating engagement with gears 98b, 100b respectively, by conventional means such as press on nuts or retainers 102b, 104b. It will thus be appreciated that rear wheels 18b, 20b are powered by motor 34b and are coupled together through drive train 90b for common rotation. Having described one side of the vehicle 80, it is should be understood that the opposing side of the vehicle is a mirror image.

Figure 11:
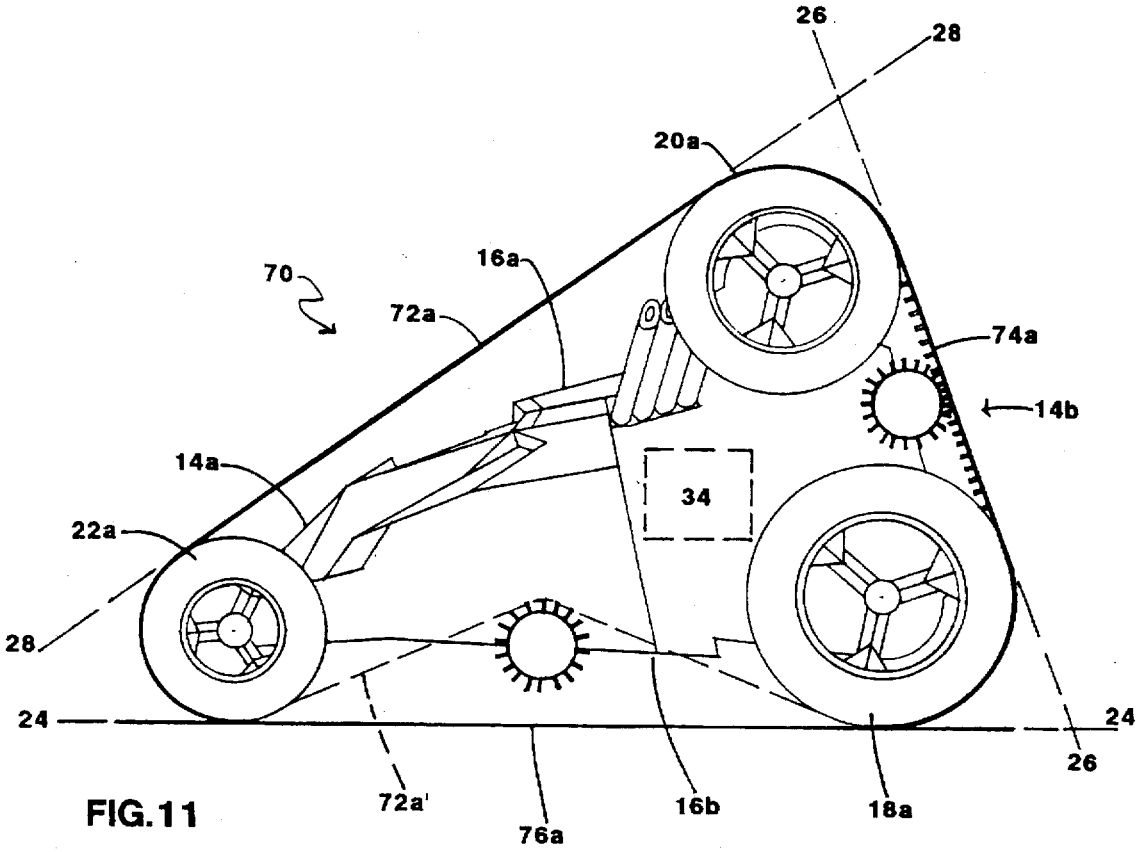
FIG. 11 is a side view of a third embodiment vehicle toy with the body indicated in phantom for clarity.

Referring now to FIG. 11, a tracked embodiment of the present invention is shown. The tracked embodiment of the vehicle toy, indicated generally at 70, is basically the same as the non-tracked version of the vehicle 10, as previously described. Since the basic vehicle 10 has already been described, those features which do not differ from the previously described version will not be described again. As before, the vehicle 70 comprises first and second lateral sides 12a, 12b, front and rear ends 14a, 14b, and an outer perimeter. Additionally, the vehicle has a top and a bottom side 16a, 16b. The outer perimeter of the vehicle 70 is defined herein as circumscribing the vehicle 70 between the lateral sides 12a, 12b. The outer perimeter of the vehicle 70 extends around the front end 14a of the vehicle 70, over the top side 16a around the rear end 14b, along bottom side 16b and back to the front end 14a.

The vehicle toy 70 has at least three pairs of vehicle supporting wheels, each pair having a common rotational axis. FIG. 11 being a side view, only one side of the vehicle 70 is shown in detail. However, it should be understood that the other side is a mirror image thereof. Only one wheel of each wheel pair is shown, indicated at 18a, 20a, and 22a. The wheels of each wheel pair are opposed to one another on the first and second lateral sides. The wheels on each lateral side of the vehicle are arranged in a polygon at the outer perimeter of the vehicle 70, such that adjoining pairs of the wheels define planes which are mutually transverse to one another and which entirely circumscribe the outer perimeter of the vehicle. The mutually transverse planes are indicated by dashed lines 24, 26, and 28.

In this embodiment of the vehicle 70, a continuous belt or track, like track 72a, is engaged over the at least three wheels 18a, 20a, 22a on the lateral side of the vehicle 70. Only the left side track 72a is indicated in FIG. 11. The track 72a may mounted around the wheels under tension to provide a friction engagement between each of the wheels, or, preferably the track 72a may be drivingly engaged with one or more of the wheels 18a, 20a, 22a (neither depicted) via a toothed surface on one or more of the wheels and a complimentary toothed surface an inner side of the tracks, as disclosed in U.S. Pat. No. 5,135,427, which is incorporated by reference herein. Thus, the vehicle 70 has a first track 72a engaged over the wheels 18a, 20a, 22a on the first lateral side 12a and a second track engaged over the wheels 18b, 20b, 22b on the second lateral side 12b of the vehicle 70. The motor means 34 drive the first track 72a and the second track through the wheels 18a/18b, 20a/20b, 22a/22b.

Although the vehicle 70 shown has three wheel pairs, it is within the scope of the present invention that more than three pairs of wheels may be used, such that the wheels on each lateral side of the vehicle are arranged in a polygon at the outer perimeter of the vehicle, and circumscribe the outer perimeter of the vehicle. If more than three pairs of wheels are used, adjoining pairs of the wheels would define three or more planes which are mutually transverse to one another.

A motor means 34 (in phantom) is preferably drivingly coupled with at least two pairs of the wheels on each lateral side of the vehicle 70 for driving the at least two pairs of wheels. The track 72a, being engaged with the wheels 18a, 20a, 22a, propels the vehicle as the wheels are driven. In the tracked version of the vehicle 70, track 72a may also be engaged with one or more pairs of toothed wheels, two alternate configurations being indicated in phantom at 74a, 76a. The one or more pairs of toothed wheels can be driven by the motor means 34, in which case none of the at least three wheel pairs need be directly coupled with the motor means 34.

The track or belt 72a may be engaged over the at least three wheel pairs and one toothed wheel 74a in a vehicle supporting position as shown, or the track 72a may be engaged over the at least three wheel pairs and threaded inwardly from a transverse plane like track section 72a' around an inward facing side of one of the toothed wheels, as shown in phantom at toothed wheel 76a. The latter may be a sprocket with teeth extending through openings in track 72a' as there would be no danger of the teeth of wheel 76a contacting a support surface through track 72a' and breaking. Thus, it is foreseen that a variety of methods of engaging a track with the at least three wheel pairs, and driving the track is possible. Moreover, when the tracks are coupled to a toothed wheel, or frictionally engaged to a wheel, the wheel not being a supporting wheel, then as the tracks are driven, the tracks can thus be made to drive the at least three wheel pairs which support the vehicle 70. As with the non-tracked version of the vehicle 10 previously described, the tracked version 70 is capable of operating on any of the mutually transverse planes 24, 26, 28 defined by the arrangement of the wheels on each lateral side of the vehicle 70, in a polygon at the outer perimeter, which entirely circumscribe the outer perimeter of the vehicle 70.

While remotely controlled toy vehicles are preferred, it is recognized that less expensive toy vehicles having some of the novel features of the invention, notably the ability to rotate onto other operational planes, can be made, and are within the scope of the invention. For instance, a wind-up or spring actuated motor means could be substituted for the twin electric motors of the present invention. Also, other non-remotely controlled vehicle toy embodiments, such as a battery powered vehicle, could be substituted for the present remote control operation.

While the preferred embodiment of the invention has been described and modifications thereto suggested, one of ordinary skill will appreciate yet other modifications, arrangements, structures and modes of operation would be possible to achieve the ultimate purpose of providing a vehicle able to operate on mutually transverse planes which circumscribe the vehicle, the planes being defined by adjoining pairs of wheels. The foregoing examples are meant to be exemplative and not limiting. It is to be understood, therefore, that the invention is not limited to the particular embodiments disclosed or suggested, but is intended to cover any modifications which are within the scope and spirit of the invention, as defined by the appended claims.

We claim:

1. A vehicle toy comprising:

first and second lateral sides, front and rear ends, and an outer perimeter;

at least three pairs of wheels, each pair having a common rotational axis, the wheels of each wheel pair being opposed to one another on the first and second lateral sides, the wheels on each lateral side of the vehicle being arranged in a polygon at the outer perimeter, such that adjoining pairs of the wheels define planes which are mutually transverse to one another and which entirely circumscribe the outer perimeter of the vehicle wherein two wheel pairs are located proximal the rear end, and one wheel pair is located proximal the front end, such that the transverse planes form a triangle;

wherein the vehicle has a center of gravity located in front of the rear wheel pairs and proximal the rear end; and wherein the vehicle can be accelerated sufficiently rapidly by the motor means and wheels to rotate the vehicle in a first direction from one of the planes to an adjacent one of the planes.

2. The vehicle of claim 1 further comprising a controller responsive to control signals received from a source remote to the vehicle and coupled with the motor means to control operation of the motor means.

3. The vehicle of claim 2 further comprising a radio receiver coupled with the controller to provide remote radio control of the motor means.

4. The vehicle of claim 3 wherein the motor means comprises:

a first reversible electric motor drivingly coupled to at least two wheels on one of the first and second lateral sides of the vehicle; and a second reversible electric motor, independently operable from the first motor, drivingly coupled to the opposing two wheels on a remaining one of the first and second lateral sides of the vehicle.

5. The vehicle of claim 1 further comprising:

a first track engaged over said wheels on said first lateral side; and a second track engaged over said wheels on said second lateral side, wherein said motor means drive said first and second tracks through said wheels.

6. The vehicle of claim 1 wherein the two pairs of wheels proximal the rear end are spaced sufficiently far apart from one another such that the vehicle can maintain itself upright on the two pairs of wheels proximal the rear end when the vehicle is operated with the two pairs of wheels proximal the rear end in contact with a surface supporting the vehicle.

7. The vehicle of claim 1, wherein two wheels on one of the lateral sides of the vehicle are powered by one motor and are coupled together for common rotation.

8. The vehicle of claim 7 wherein the two pairs of wheels proximal the rear end are the powered pairs of wheels.

9. The vehicle of claim 8 wherein at least one of the at least three pairs of wheels proximal the front end is unpowered by the motor means and wherein the vehicle is balanced and powered sufficiently to rise up from an initial orientation supported by the one pair of unpowered wheels proximal the front end and one pair of the powered wheels proximal the rear end and to rotate to a second orientation supported on the two pairs of powered wheels proximal the rear end and to remain in the second orientation until selectively accelerated sufficiently to be rotated from the second orientation to one of the first orientation and a third orientation supported on a remaining one of the pairs of powered wheels proximal the rear end and the one pair of unpowered wheels proximal the front end.

10. The vehicle of claim 9 wherein each of the vehicle wheels is mounted for rotational movement with respect to only the common rotational axis.

11. The vehicle of claim 10 further comprising a controller responsive to control signals received from a source remote to the vehicle and coupled with the motor means to control operation of the motor means.

12. A vehicle toy comprising:

first and second lateral sides, front and rear ends, and an outer perimeter;

at least three pairs of wheels, each pair having a common rotational axis, the wheels of each wheel pair being opposed to one another on the first and second lateral sides, the wheels on each lateral side of the vehicle being arranged in a polygon at the outer perimeter, such that adjoining pairs of the wheels define planes which are mutually transverse to one another and which entirely circumscribe the outer perimeter of the vehicle; and motor means drivingly coupled with at least two pairs of wheels for driving the at least two pairs of wheels;

wherein two wheel pairs are located proximal the rear end, and one wheel pair is located proximal the front end, such that the transverse planes form a triangle; and wherein the two pairs of wheels proximal the rear end are spaced sufficiently far apart from one another such that the vehicle can maintain itself upright on the two pairs of wheels proximal the rear end when the vehicle is operated with the two pairs of wheels proximal the rear end in contact with a surface supporting the vehicle.

13. The vehicle of claim 12 wherein the vehicle has a center of gravity located in front of the rear wheel pairs and proximal the rear end.

14. The vehicle of claim 13 wherein the vehicle can be accelerated sufficiently rapidly by the motor means and wheels to rotate the vehicle in a first direction from one of the planes to an adjacent one of the planes.

15. A vehicle toy comprising:

first and second lateral sides, front and rear ends, and an outer perimeter;

first, second and third wheels pairs, each wheel pair having a common rotational axis, the wheels of each wheel pair being located opposite one another on the first and second lateral sides, and the wheels on each lateral side of the vehicle being triangularly positioned to entirely circumscribe the outer perimeter, such that only two wheel pairs contact a generally level surface at a time and such that the vehicle can be operated on any two adjoining pairs of the three pairs of wheels;

a first reversible electric motor drivingly coupled with at least two wheels on the first lateral side, the at least two wheels being coupled together for common rotation; and a second reversible electric motor drivingly coupled independently of the first motor with at least two wheels on the second lateral side opposing the at least two coupled wheels on the first lateral side, the wheels on the second lateral side being coupled together for common rotation.

16. The vehicle of claim 15 further comprising a controller responsive to control signals received from a source remote to the vehicle and coupled with the motors to control operation of the vehicle.

17. The vehicle of claim 15 wherein the first and second wheel pairs are located proximal to the rear end of the vehicle, and the third wheel pair is located proximal the front end of the vehicle.

18. The vehicle of claim 17 wherein the second wheel pair is located forward from and above the first wheel pair when the vehicle is supported on the first and third wheel pairs.

19. The vehicle of claim 18 wherein the third wheel pair has a diameter which is less than a diameter of the second wheel pair and the diameter of the second wheel pair is less than a diameter of the first wheel pair.

20. The vehicle of claim 17 wherein the third wheel pair is non-powered.

21. The vehicle of claim 20 wherein the vehicle is balanced and powered sufficiently to rise up from an initial orientation supported on the first and third wheel pairs, and rotate to a second orientation supported on the first and second wheel pairs, and to rotate from the second orientation to a third orientation supported on the second and third wheel pairs.

22. The vehicle of claim 21 wherein each of the wheels is mounted for rotational movement with respect only to the common rotational axis.

23. The vehicle of claim 22 wherein the vehicle center of gravity is located proximal to and forward of the first and second wheel pairs, so that the vehicle is balanced to operate on any of the adjacent wheel pairs.

24. A vehicle toy comprising:

first and second lateral sides, front and rear ends, and an outer perimeter;

at least three pairs of wheels, each pair having a common rotational axis, the wheels of each wheel pair being opposed to one another on the first and second lateral sides, the wheels on each lateral side of the vehicle being arranged in a polygon at the outer perimeter, such that adjoining pairs of the wheels define planes which are mutually transverse to one another and which entirely circumscribe the outer perimeter of the vehicle, wherein two wheel pairs are located proximal the rear end, and one wheel pair is located proximal the front end, such that the transverse planes form a triangle;

a first reversible electric motor drivingly coupled to at least two wheels proximal the rear end on one of the two lateral sides of the vehicle;

a second reversible electric motor, independently operable from the first motor, drivingly coupled to at least two wheels proximal the rear end on a remaining one of the two lateral sides of the vehicle opposing the two wheels on the one lateral side;

a controller responsive to control signals received from a source remote to the vehicle, the controller being coupled with the first and second electric motors; and the vehicle being balanced and powered sufficiently to rise up from an initial orientation supported by one pair of unpowered wheels proximal the front end and one pair of the powered wheels proximal the rear end and to rotate to a second orientation supported on the two pairs of powered wheels proximal the rear end and to be rotated from the second orientation to a third orientation supported on a remaining one of the pairs of powered wheels proximal the rear end and the one pair of unpowered wheels proximal the front end.

25. A vehicle toy comprising:

first and second lateral sides, front and rear ends, and an outer perimeter;

at least three pairs of wheels, each pair having a common rotational axis, the wheels of each wheel pair being opposed to one another on the first and second lateral sides, the wheels on each lateral side of the vehicle being arranged in a polygon at the outer perimeter, such that adjoining pairs of the wheels define planes which are mutually transverse to one another and which entirely circumscribe the outer perimeter of the vehicle; and motor means drivingly coupled with at least two pairs of wheels for driving the at least two pairs of wheels;

wherein two wheel pairs are located proximal the rear end, and one wheel pair is located proximal the front end, such that the transverse planes form a triangle;

wherein two wheels on one of the lateral sides of the vehicle are powered by one motor and are coupled together for common rotation;

wherein the two pairs of wheels proximal the rear end are the powered pairs of wheels;

wherein at least one of the at least three pairs of wheels is unpowered by the motor means, the at least one pair of unpowered wheels being located proximal the front end; and wherein the vehicle is balanced and powered sufficiently to rise up from an initial orientation supported by the one pair of unpowered wheels proximal the front end and one pair of the powered wheels proximal the rear end and to rotate to a second orientation supported on the two pairs of powered wheels proximal the rear end and to remain in the second orientation until selectively accelerated sufficiently to be rotated from the second orientation to one of the first orientation and a third orientation supported on a remaining one of the pairs of powered wheels proximal the rear end and the one pair of unpowered wheels proximal the front end.

* * * * *